US006883995B1

(12) United States Patent
Gueret

(10) Patent No.: US 6,883,995 B1
(45) Date of Patent: Apr. 26, 2005

(54) APPLICATOR DEVICE FOR APPLYING A LIQUID PRODUCT

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 186 days.

(21) Appl. No.: 09/691,944

(22) Filed: Oct. 20, 2000

(30) Foreign Application Priority Data

Oct. 22, 1999 (FR) ..... 99 13223

(51) Int. Cl.[7] ..... B43K 5/00
(52) U.S. Cl. ..... 401/202; 401/205; 401/183
(58) Field of Search ..... 401/206, 205, 401/202, 198, 196, 183–185

(56) References Cited

U.S. PATENT DOCUMENTS

| | | | | | |
|---|---|---|---|---|---|
| 1,315,305 | A | * | 9/1919 | Hegland | 401/148 |
| 1,918,215 | A | * | 7/1933 | Runnels | 401/132 |
| 2,659,919 | A | * | 11/1953 | McCabe et al. | 220/522 |
| 2,837,756 | A | * | 6/1958 | Barlow et al. | 15/105 |
| 2,841,809 | A | * | 7/1958 | Oliver | 132/74.5 |
| 2,853,727 | A | * | 9/1958 | Nadai | 401/199 |
| 2,975,464 | A | * | 3/1961 | Schultz | 206/229 |
| 3,084,375 | A | * | 4/1963 | Schwartzman | 401/206 |
| 3,113,336 | A | * | 12/1963 | Langnickel | 401/198 |
| 3,129,452 | A | * | 4/1964 | Schwartzman | 264/249 |
| 3,132,370 | A | * | 5/1964 | Capezzuto | 401/183 |
| 3,133,309 | A | * | 5/1964 | Miles | 401/202 |
| 3,266,079 | A | * | 8/1966 | Schwartzman | 401/202 |
| 3,444,808 | A | * | 5/1969 | Schwartzman | 101/125 |
| 3,463,597 | A | * | 8/1969 | Wakai | 401/206 |
| 3,601,287 | A | | 8/1971 | Schwartzman | |
| 3,661,468 | A | * | 5/1972 | Schwartzman | 401/206 |
| 4,084,033 | A | * | 4/1978 | Drelich | 428/198 |
| 4,225,253 | A | * | 9/1980 | Fraleigh | 401/9 |
| 5,022,517 | A | * | 6/1991 | Benitez | 206/77.1 |
| 5,082,386 | A | * | 1/1992 | Hironaka et al. | 401/206 |
| 5,163,767 | A | | 11/1992 | Lucas | |
| 5,368,581 | A | * | 11/1994 | Smith et al. | 604/290 |
| 5,562,650 | A | * | 10/1996 | Everett et al. | 604/378 |
| 6,386,781 | B1 | * | 5/2002 | Gueret | 401/198 |

FOREIGN PATENT DOCUMENTS

| | | |
|---|---|---|
| DE | 36 25 418 | 2/1988 |
| EP | 0 390 922 | 10/1990 |
| EP | 0 872 193 | 10/1998 |
| WO | WO 98/39991 | 9/1998 |

OTHER PUBLICATIONS

English language Derwent Abstract of DE 36 25 418.
English language Derwent Abstract of EP 0 872 193.

* cited by examiner

*Primary Examiner*—Gregory L. Huson
*Assistant Examiner*—Huyen Le
(74) *Attorney, Agent, or Firm*—Finnegan, Henderson, Farabow, Garrett & Dunner, L.L.P.

(57) ABSTRACT

An applicator device for applying a liquid product is provided. The applicator device includes a reservoir for containing the product, and having an opening; a removable closure member for sealing the opening; and an applicator member mounted in fluid communication with the reservoir. The applicator member preferably includes at least one block formed of an absorbent material, capable of being compressed. According to the invention, an elastically compressible structure forms a support for the applicator member, the support having a compressibility that is greater than the compressibility of the applicator member.

148 Claims, 10 Drawing Sheets

APPLICATOR DEVICE FOR APPLYING A LIQUID PRODUCT

The present invention relates to a dispenser for storing and applying a product of liquid consistency. The invention is quite particularly intended for the storing and application of cosmetic products such as liquid foundation, nail varnish, lipstick, oils, possibly in the form of gel, creams, lotions, hair care treatments, etc. Applications in fields other than the field of cosmetics may also be envisaged, particularly in the field of skin care or in the fields of glues, correction fluids, household stain removers, etc. Liquid products, the viscosity of which is between that of water and that of an oil, or even that of creams or lotions in the form of gels, are particularly suited to being dispensed according to the present invention.

There are, in existence, devices of the stain-removal pad type, which consist of a reservoir of product surmounted by a neck, at the top of which there is an applicator in the form of a pad of foam which is applied to a surface that is to be treated, for example to the skin or to a fabric, the applicator pad being confined in the top part of the neck. To cause the application pad to become laden with product, the reservoir has to be inverted and its applicator surface pressed several times against the surface that is to be treated so as to "pump" and cause the pad to become laden with product before the product can be applied. The pressure exerted on the applicator causes the opening of a valve, which when in the closed position, isolates the applicator from the product. These applicators, which generally contain volatile formulas, often dry out very quickly during the period of storage, causing a crust to form on the applicator.

In alternative products, of the polish type, where the applicator pad is also isolated from the product by means of a valve, the applicator dries out even more quickly, sometimes making it unusable after a lengthy period of non-use, or entailing washing operations prior to any further use.

Also known are applicators in the form of a block of foam which is dipped into the product that is to be applied and then, after wringing out, either on the neck of the bottle, or through an elastic wringing-out device, are applied to the surface that is to be treated. The applicator is generally secured to the cap. The metering of the product that is to be applied by the impregnating of the applicator is difficult to alter from one product to another according to the varying rheology of the products. Furthermore, it is somewhat tricky to use under certain circumstances, on public transport for example, because of the fact that the applicator and the reservoir are independent, meaning that the container needs to be held steady in one hand, and product applied with the other hand, under such conditions of use.

Patent application EP-A-0 923 323, describes a unit for applying a cosmetic product, particularly in the form of a block of friable solid product, comprising a casing that is open at one of its ends. This unit further comprises a platform on which the product is mounted, the platform being able to move axially inside the casing, drive means being provided for adjusting the height of the platform inside the casing. Actuating means, accessible from one end of the casing, are intended to operate the drive means. Elastic means make it possible, under the effect of pressure exerted roughly axially on an applicator surface of the product, to cause the product to effect a relative displacement inside the casing, against a return force exerted by the elastic means. This device is not suited to the applying of a product of liquid to viscous consistency.

Patent application EP-A-0 872 193 describes a unit for applying a liquid product, comprising a reservoir for the product. It has a neck, a free edge of which defines an opening, and removable means for sealing the opening are provided. An applicator in the form of a block of open or semi-open cell foam, capable of becoming laden with product by pumping, is mounted inside the neck. This applicator has a first end in permanent liquid communication with the product inside the reservoir, and a second end, opposite the first end, forming an applicator surface. The applicator surface can move axially between a first position in which the applicator surface emerges out from the neck through the opening, so that product can be applied, and a second position in which the applicator surface is contained inside the reservoir. The movement of the applicator surface from the first position into the second position is brought about by elastic thrust against a stoppering means, movement of the applicator surface from the second position to the first being brought about by removing the stoppering means.

Certain materials forming the applicator member deteriorate, particularly when exposed to the said elastic thrust for lengthy periods of time. Further, it is desirable to improve the tailoring of the dose of product to be applied according to the rheology of the product, without causing excess product to flow out, as this would risk dirtying the neck of the reservoir.

Hence, one of the objects of the invention is to eliminate the drawbacks of the packaging unit that was the subject of patent application EP-A-0 872 193, particularly by limiting the compression of the applicator member in the deployed position (equivalent to the position of use) supporting the application member while at the same time metering its delivery and doing so over a determined decompression travel, for good use.

Another object of the invention is to provide a packaging and applicator unit in which the applicator member can be supplied with a dose, adjustable to suit the nature of the product, and, in particular, where this can be constant.

A further object of the invention is to supply a system which has a great deal of application autonomy, such that it is not always necessary to keep the applicator member in contact with the product during application.

A further object of the invention is to provide a system which makes application very smooth.

Yet another object of the invention is to provide a system which allows excess product to be reabsorbed into the unit without product running down the outside, and which makes sure that the applicator is clean at the time of use, by controllable compression of the applicator member, either at the time of use or when closing the unit.

Although the invention preferably has one or more of the above-mentioned objects and advantages, certain aspects of the invention could be practiced without necessarily accomplishing one or more of the objects and advantages.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

According to the invention, these objects are achieved by producing a unit for packaging and applying a product, particularly a liquid product, comprising:

- a reservoir with a longitudinal axis containing the said product, and having an opening; a removable closure structure for sealing the opening; an applicator member mounted inside the reservoir and comprising a first end capable of being impregnated with the product and a second end, opposite the first end, forming an applicator surface axially movable between a first position in which the applicator surface emerges out of the reservoir through the opening with a view to applying product, and a second position in which the applicator surface is contained in a sealed fashion inside the reservoir, the applicator member comprising at least one block formed of at least one absorbent material configured to be at least partially compressed, particularly when applying product, or when the applicator is in the second position.

According to the invention, an elastically compressible element forms a support for the applicator member, the support having a compressibility that is greater than the compressibility of the applicator member. In a preferred embodiment, this is achieved by providing a support having a lower density than the density of the applicator member.

Advantageously and according to the present invention, the applicator member and the support are chosen so that when appropriate pressure is exerted on the applicator member towards the support, the maximum compression of the support is obtained before maximum compression of the applicator member is reached.

In practice, good results can be obtained when the compressibility of the support is about two to four times greater than the compressibility of the applicator member.

Thus, when the applicator surface moves from the first position into the second position through a given travel, the initial height of the support decreases, for example, by about ⅔ to ⅘ of the total travel, the initial height of the applicator member decreasing by about ⅓ to ⅕ of the travel.

According to one embodiment, the support may include an element that is distinct from the applicator member. In this case, the support includes, for example, of an element forming a spring, particularly one made of metal or plastic.

According to another, particularly preferred embodiment, the support includes at least one block of an elastically deformable material, particularly a block of foam, preferably with open or semi-open cells.

Advantageously, at least one block of elastically deformable material forming the support is secured to the applicator member.

According to one advantageous embodiment, the applicator member is held fast on the support by bonding, welding, crimping or by any other appropriate means.

As appropriate, the support may include a stack of at least two blocks of elastically deformable material, the stack having a compressibility that increases in the direction towards the reservoir.

According to one particularly advantageous feature of the invention, the support includes at least one portion of the applicator member, which portion is configured in such a way as to have greater compressibility than the remainder of the applicator member. In this case, the portion may include a zone of smaller cross section, by comparison with the cross-section of the remainder of the applicator member.

Thus, the difference in compressibility between the applicator member and the support may result from the presence of an indentation formed by the applicator member on at least part of its periphery.

As an alternative, the difference in compressibility between the applicator member and the support may result from the presence of a central recess formed by the applicator member and extending over at least part of the height of the applicator member.

In particular, the shape of the indentation or of the recess of the support may vary (be progressive or regressive) according to its axial level.

Advantageously, the applicator member has at least one passage, preferably in the form of one or more slits, or of a fine channel, passing through it, this passage preferably opening onto the applicator surface, so as to increase the product metering capacity and delivery. When a number of slits are provided, these may be arranged in the shape of a cross or in the shape of a star.

As a preference, the applicator member and the support are arranged inside a housing formed at least partially inside a neck of the reservoir, the housing being in fluid communication with the reservoir. Advantageously, this housing is of cylindrical or frustoconical shape, particularly flaring towards the outside. It may, for example, have a circular, oval, rectangular or polygonal cross-section.

According to another embodiment, the housing is separated from the remainder of the reservoir by a perforated element, particularly one in the form of a grating, a sieve or a valve which opens one way towards the applicator surface. The perforated element may comprise passages capable, by capillary action, of holding a metered dose of product. The dose of product held can be transferred, by compression of the reservoir and/or by suction by the applicator member, onto the applicator surface via the support.

As for the applicator surface, it may have a concave or convex profile, particularly in the form of a dome, or a single or double bevel. The shape of the applicator surface is chosen, in particular, according to the nature of the product to be applied and the spot to be treated. Hence, for a nail varnish applicator, a bevelled shape will be chosen, whereas for applying a moisturizing cream to the face, a dome shape is more suitable.

According to another advantageous aspect of the invention, the applicator member is formed, at least in part, of a block of elastically compressible material, preferably a block of open or semi-open cell foam or any other spongy material. The applicator member may comprise, near its applicator surface, a frit, a rigid foam, a perforated element, particularly a woven, a non-woven, a felt or a mesh. Advantageously, when this part includes a frit material, it may be chosen from polyvinyl chloride, ethylene vinyl acetate, polyethylene, polyethylene terephthalate or polyamide frits.

Advantageously, the removable closure element for closing the opening is configured, as it is fitted onto the reservoir, to cause the applicator surface to move from the first position into the second position.

This closure element, according to one embodiment, includes a screw-on or snap-on cap. Alternatively, the closure element includes a lid, hinged to the open end of the housing. In this case, the lid is advantageously hinged to the open end using a film hinge.

According to an advantageous aspect of the invention, the removable closure element may comprise an internal profile capable of making a seal with the open end of the housing, it being possible moreover for the internal profile to have a shape that complements the shape of the applicator surface. Thus, loadings can be uniformly distributed over the entire applicator surface and the constituent material uniformly compressed. As the foam of the applicator member expands, the expanding cells of the foam uniformly pump the product. As the applicator member is pressed against the surface that is to be treated, this has the effect of releasing the product uniformly.

According to another aspect of the invention, the closure element comprises a structure, particularly in the form of a block of foam capable, when the reservoir is closed, of engaging with the applicator surface. This block of foam may be deformable and may be impregnated with an appropriate solvent or preservative. When the unit is closed, the block of foam presses gently against the applicator member. This makes it possible to avoid damage to the applicator surface, particularly when the application surface is fragile, which it might be if covered with a coating of flocking. The presence of a solvent in the foam prevents the product from drying out on the applicator surface. The presence of a preservative in the foam prevents the proliferation of microorganisms on the applicator surface or the degradation of the product by oxidation.

When the applicator member is a foam, this foam may be chosen from polyurethane, polyethylene, polyvinyl chloride, polyether, polyester, NBR (natural rubber), and SBR (synthetic rubber) foams.

According to a preferred embodiment of the invention, the applicator member comprises a side wall capable, at least in the second position of the applicator surface, of making practically sealed contact with an internal wall delimited by a housing in which the applicator member and the support are mounted.

Advantageously, the side wall of the applicator member is provided with at least one groove, for example a longitudinal or helical groove, so as to improve the air intake passage, which air intake is permitted also by the presence of the open or semi-open cells which form all or part of the applicator member. This groove also allows any excess product that has accumulated on the surface to be reabsorbed as the applicator surface moves from the first (application position) to the second (retracted) position.

To the same end, as an alternative, the internal side wall of the housing may have at least one longitudinal or helical groove. As a preference, a number of longitudinal grooves will be made, these being uniformly distributed on the internal lateral surface of the housing, or on the external lateral surface of the applicator member.

According to a particularly advantageous arrangement, the applicator member may be mounted in such a way that it can be removed and repositioned in the reservoir. This arrangement allows either the applicator member to be cleaned or it to be replaced with another applicator member of a different kind.

According to another advantageous feature of the invention, the applicator surface may be covered with flocking. In this case, the flocking may inlcude bristles of different diameters and/or nature and/or height or of a mixture of such bristles. The combination of a foam with a covering of flocking on its applicator surface has been proven to produce entirely remarkable results.

Advantageously, the applicator member has open pores or cells of a mean size of from 200 $\mu$m to 1.5 mm, preferably from 700 $\mu$m to 1 mm, and more particularly from 0.1 mm to 0.5 mm.

When the applicator member is made of foam, the nature of the foam and the size of the cells that form it are chosen according to the rheology of the material that is to be applied, particularly its viscosity and its surface tension, and according also to the desired product delivery rate. As a preference, the applicator member comprises at least 10% of open or semi-open cells. It will therefore be possible, according to the percentage of open or semi-open cells in the applicator member, to tailor the product delivery rate according to its rheology.

Preferably, the support directly or indirectly determines the limit on the degree of compression of the applicator member so as to avoid excessive release of the product contained in the applicator member, the tailoring of the metering and delivery of the pumped product, the ease of moving the applicator surface from the first position into the second, and the tailoring of the gentleness of application.

Advantageously, when the support is formed by a block of foam, this foam has open cells with a mean size of from 50 $\mu$m to 3 mm, and preferably from 700 $\mu$m to 2 mm, and more particularly from 0.1 mm to 1.5 mm. In this case, the foam may be chosen, for example, from polyurethane, polyethylene, polyvinyl chloride, polyether, polyester, NBR (natural rubber), and SBR (synthetic rubber) foams. Preferably the type of foam and the mean size of the cells of the foam are chosen to provide a foam which has a lower density than the density of the application member.

According to one aspect of the present invention, an applicator device for applying a liquid product is provided. The applicator device includes a reservoir for containing the liquid product, the reservoir having an opening, a removable closure member for sealably closing the opening, an applicator member provided in the reservoir, the applicator member including a first end portion configured to be impregnated with the product and a second end portion, opposite the first end portion, the second end portion including a product application surface and being axially moveable between a first position wherein the second end portion extends out of the reservoir through the opening, and a second position wherein the second end portion is at least substantially contained in the reservoir, the applicator member including at least one block formed of at least one absorbent material capable of being at least partially compressed, and an elastically compressible support supporting the applicator member in the reservoir, the support having a compressibility greater than the compressibility of the application member.

According to another aspect of the present invention, a method of applying a cosmetic product is provided. The method includes providing an applicator device comprising a reservoir for containing the liquid product, the reservoir having an opening, a removable closure member for sealably closing the opening, an applicator member provided in the reservoir, the applicator member including a first end portion configured to be impregnated with the product and a second end portion, opposite the first end portion, the second end portion including a product application surface and being axially moveable between a first position wherein the second end portion extends out of the reservoir through the opening, and a second position wherein the second end portion is at least substantially contained in the reservoir, the applicator member including at least one block formed of at least one absorbent material capable of being at least partially compressed, and an elastically compressible support supporting the applicator member in the reservoir, the support having a compressibility greater than the compressibility of the application member, with a cosmetic product in the reservoir, pressing on the product application surface of the applicator member to supply the cosmetic product to the applicator member, and placing the product application surface in contact with an area to be treated to apply the cosmetic product.

According to another aspect of the present invention, an applicator device is provided. The applicator device includes a reservoir for containing the liquid product, the reservoir having an opening, and an absorbent member provided in fluid communication with the reservoir, the absorbent member comprising at least two portions, a first application portion configured to apply the liquid product to a surface to be treated, and a second support portion configured to elastically support the first portion, wherein the first portion has a different density than the second portion.

According to one embodiment, the housing in which the applicator member and the support are housed, is formed by a neck, mounted on the reservoir via an intermediate member. In this case, the support is mounted on the intermediate member, for example, by snap-fastening, screwing, bonding, welding or crimping (knocking down a thermoplastic edge in the hot state) as is explained hereinafter when describing the figures.

The reservoir may include a compressible body. For this purpose, the reservoir body may be formed of a flexible or semi-rigid material, or alternatively the body may comprise at least one elastically deformable portion, for example of the "bellows" type or of the "diaphragm" type. Pressure exerted on this deformable portion allows at least part of the applicator to be compressed, so as to increase the internal pressure, thus encouraging a dose of product to flow towards the applicator surface either directly from the reservoir (in the head-down position) or from the capillary retaining element (in the head-up position), or from the support when it is made of a spongy material (in the head-up position).

Alternatively, the body of the reservoir may be formed by a deformable tube, the bottom of which is closed by a line of welding, such as a conventional tube made of aluminium or compressible thermoplastic material. Pressure exerted on the flexible walls of the tube encourages the applicator member to become better laden with product via the support-forming means.

In general, regardless of the shape of the reservoir, it may be made of metal, glass or of a thermoplastic material chosen, in particular, from polyethylenes, polypropylenes, polyvinyl chlorides and polyethylene terephthalates.

A mixing element, such as a ball or small weight may be placed inside the reservoir so as to encourage the mixing of the product, possibly break down its thixotropy and make it easier for the applicator member to become laden.

The preferred way in which the unit according to the invention works is as follows. When the compressed block of foam of the applicator member and/or of the support relaxes, either after application or upon opening the lid which keeps it compressed, or during any other decompression phase, it pumps product via the open or semi-open cells of which it is made, so that the applicator member is always laden with product, and therefore always ready for further applications. In other words, according to the invention, the applicator member essentially becomes laden with product by the compression/decompression of the compressible part of the applicator member and/or of the support.

Thus, the open-cell or semi-open-cell applicator member capable of pumping the liquid will always be laden or even saturated with product and will therefore always be ready for use. The pumping of the product in itself is mainly hydraulic (through the compression and relaxation of the foam).

In the application position, the product does not drip, even if the applicator member is saturated, because of the aforementioned reabsorption of product. Application is clean and can be metered as desired. Application occurs by applying the applicator surface to the surface that is to be treated. Product can be yielded by at least partially compressing the compressible block of the applicator member. By pushing the applicator surface down to a greater or lesser extent the product deposited on the surface can be metered appropriately. This is because the compressibility and/or density of the support is chosen so that the pressure that needs to be exerted, in order to apply a given amount of product without causing excess product to flow out, is less than the force needed to cause the applicator surface to move from the first position (the application position) to the second (retracted position). In other words, in order to prevent excessive release of product from occurring as a result of excessive compression of the applicator member, the support comes into operation, compensating for the excessive compression by virtue of its own compressibility which is higher than the compressibility of the applicator member. This is one of the preferred features of the invention. Once the product has been dispensed, all that remains is for it to be spread out uniformly on the support that is to be treated.

As mentioned earlier, the presence of a compressible applicator member and/or of compressible support makes it possible, aside from pumping the product during each decompression phase, for the amount of product absorbed by the surface that is to be treated to be metered, and for its delivery at the time of application to be tailored appropriately according to the type of product and the nature of the surface that is to be treated.

The product may be a cosmetic product such as a nail varnish, a liquid lipstick, a cream, a lotion or an oil, possibly in the form of a gel, a make-up remover, a nail varnish remover, a liquid foundation, a dermatological composition, or alternatively a glue, a correction fluid or a stain remover, etc.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

Figure 4A:
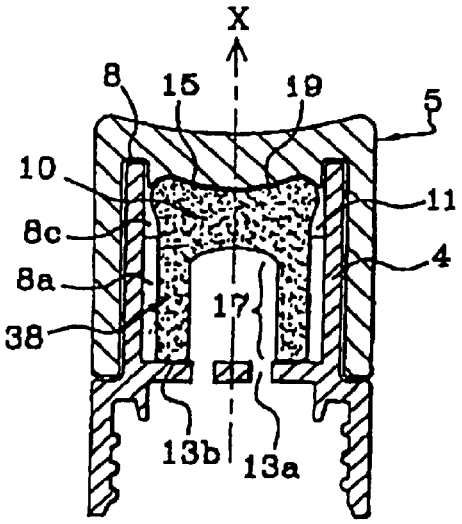
Figure 4B:
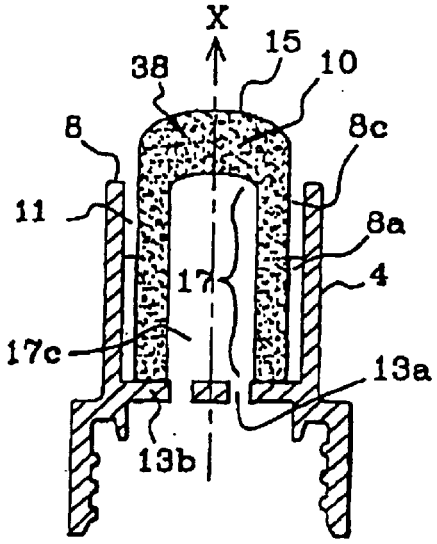
Figure 4C:
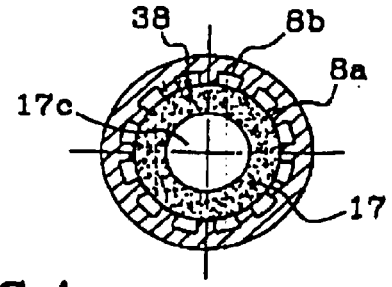

FIGS. 3*a* to 3*d* illustrate cross-sectional side views of various embodiments of the applicator member according to the present invention;

FIGS. 4*a* and 4*b* illustrate cross-sectional side views of a particularly preferred embodiment of the applicator member and support of the applicator device;

FIG. 4*c* is a cross sectional view taken along the line IVc—IVc of FIG. 4*b;*

Figure 1:
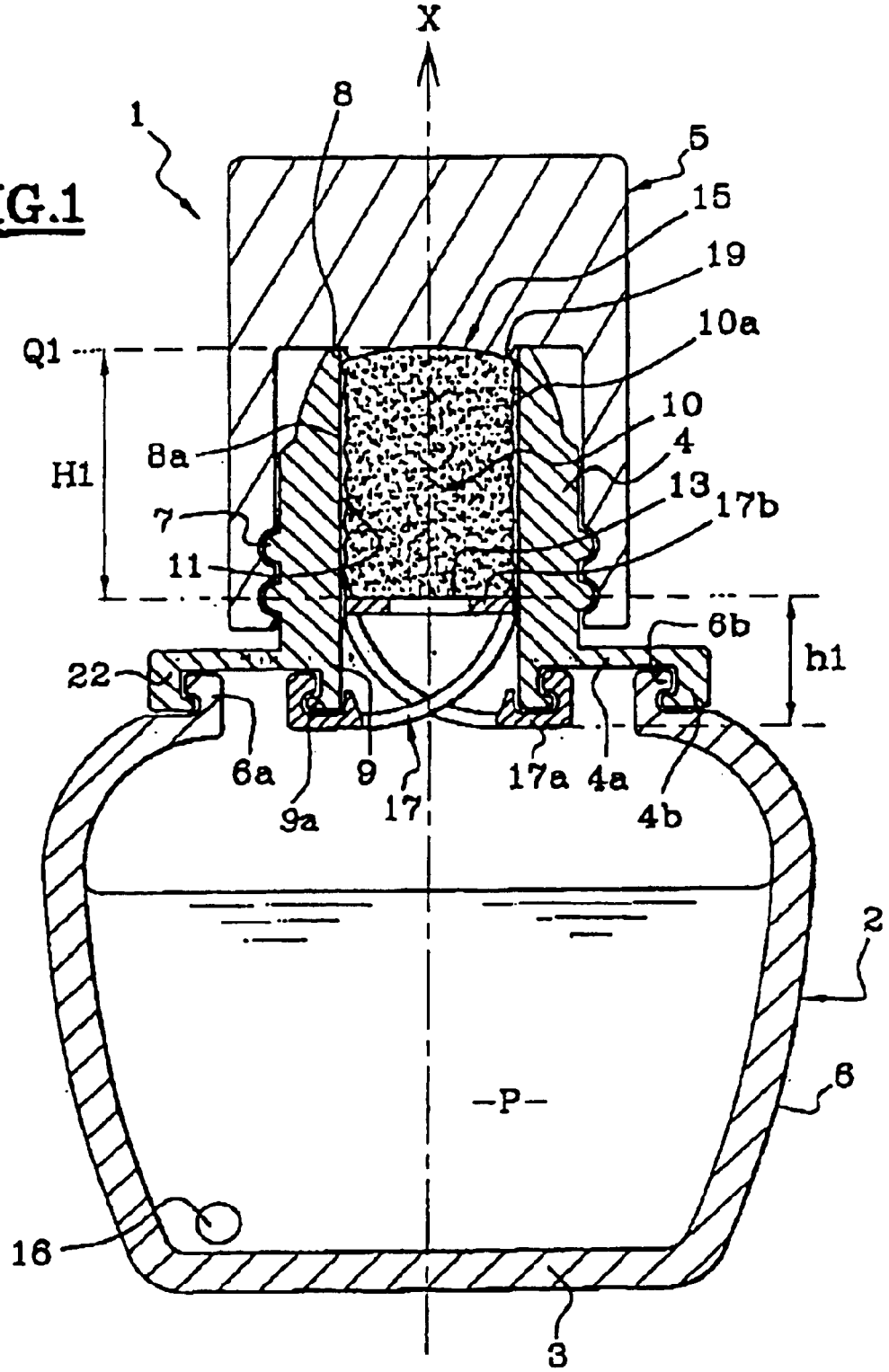
FIG. 1 depicts a view in longitudinal section of a first embodiment of the applicator device according to the invention, in the storage position (retracted position)
Figure 2:
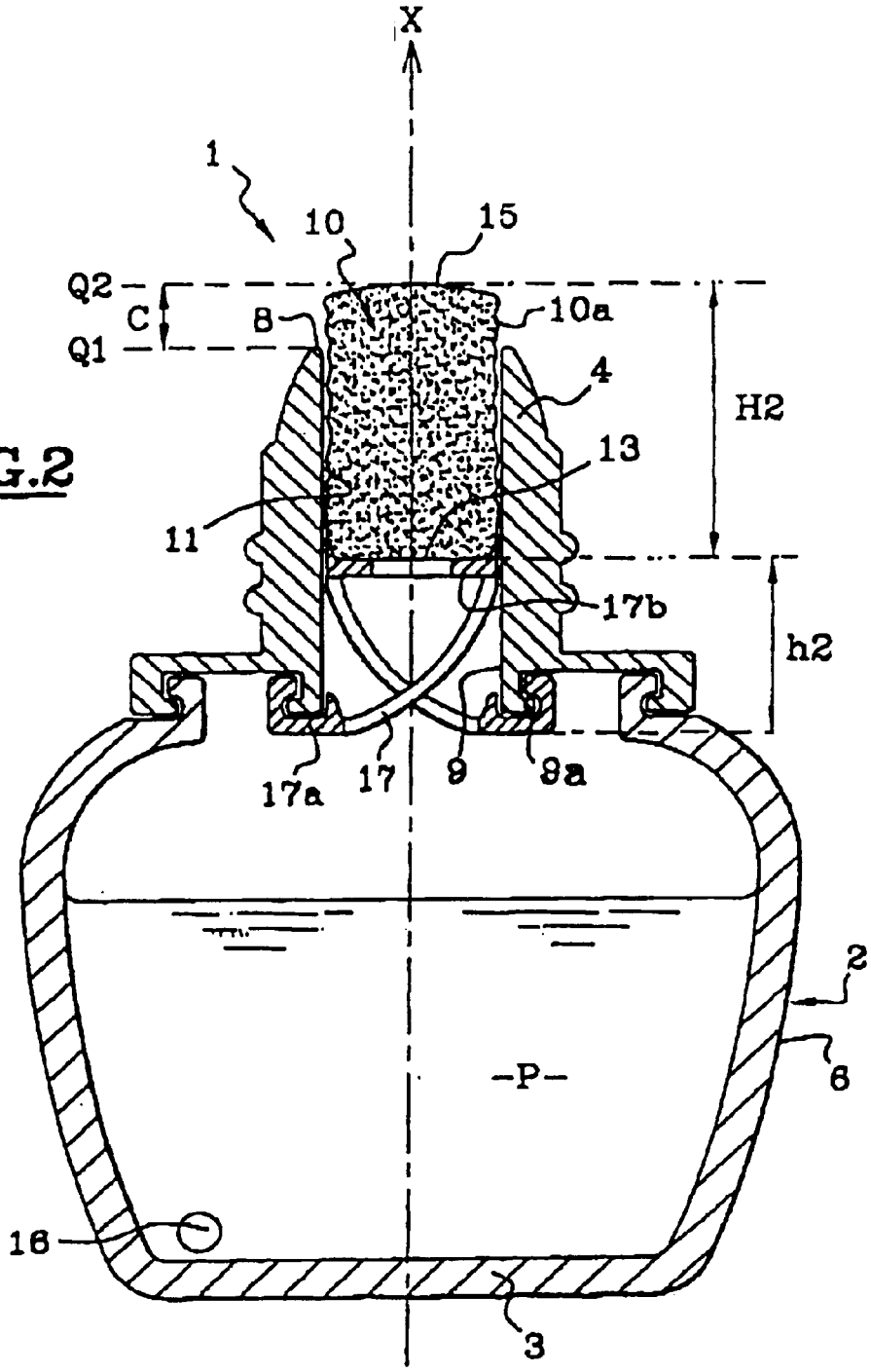
FIG. 2 depicts a view in longitudinal section of a first embodiment of the applicator device according to the invention in the position of use (deployed position)
Figure 5:
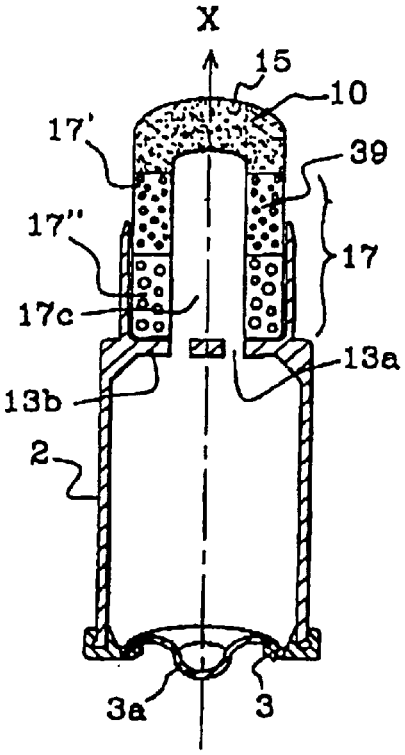
Figure 7:
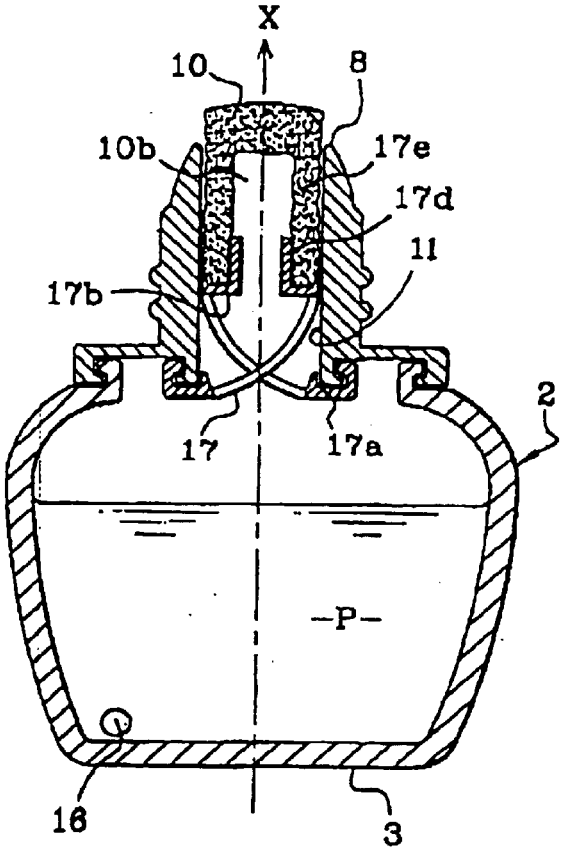
Figure 6A:
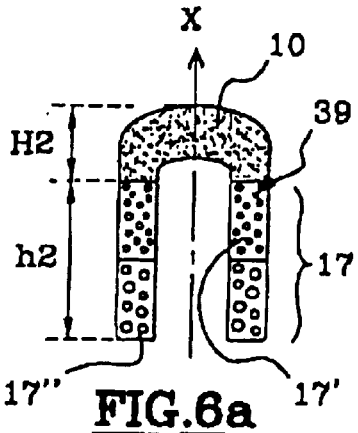
Figure 6B:
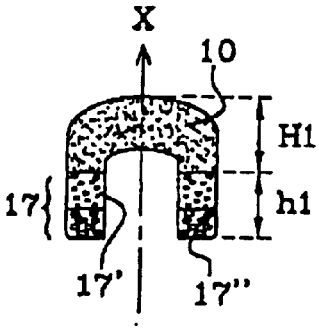
Figure 8:
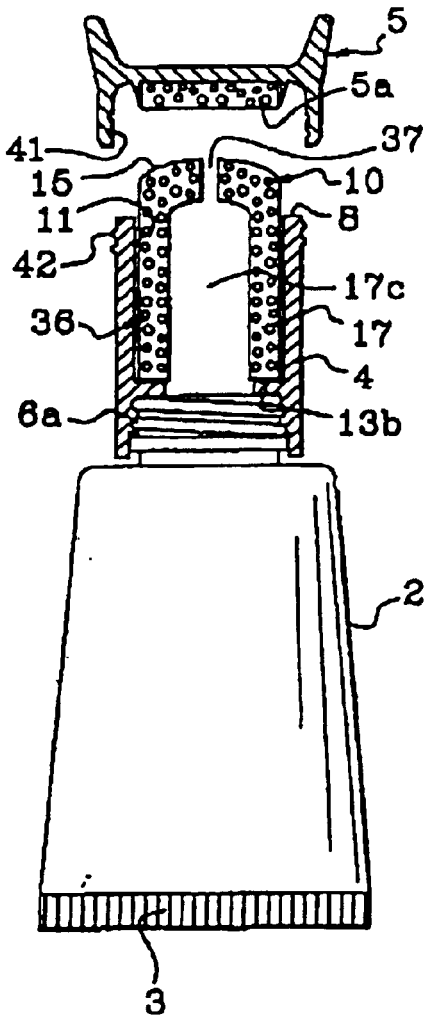
Figure 9:
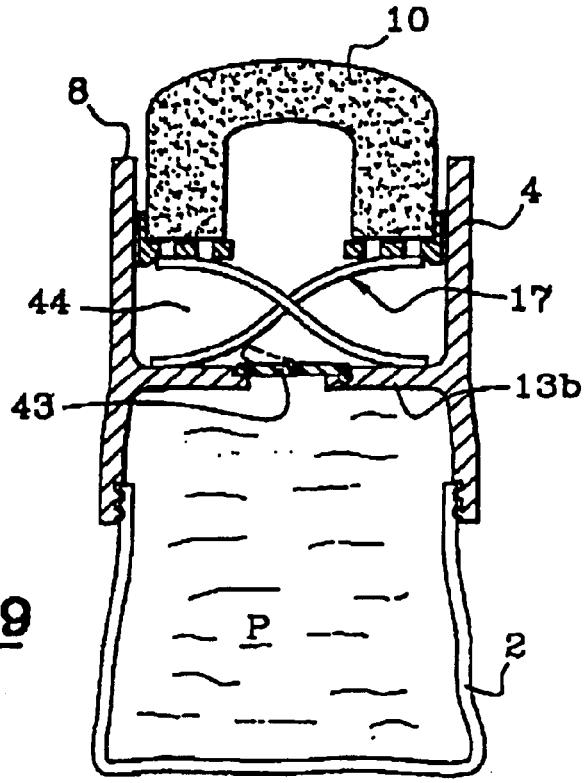
Figure 12:
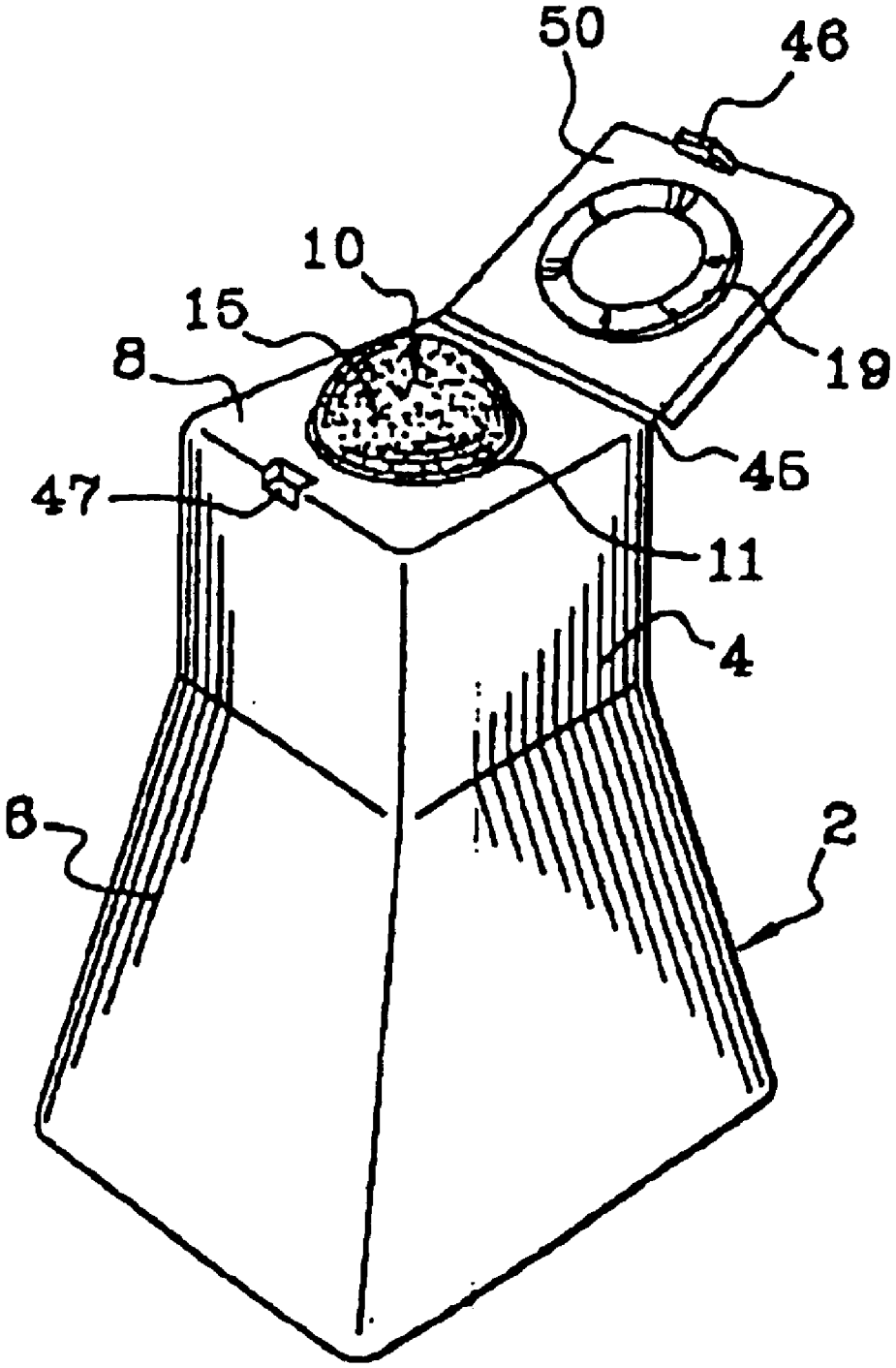
Figure 13:
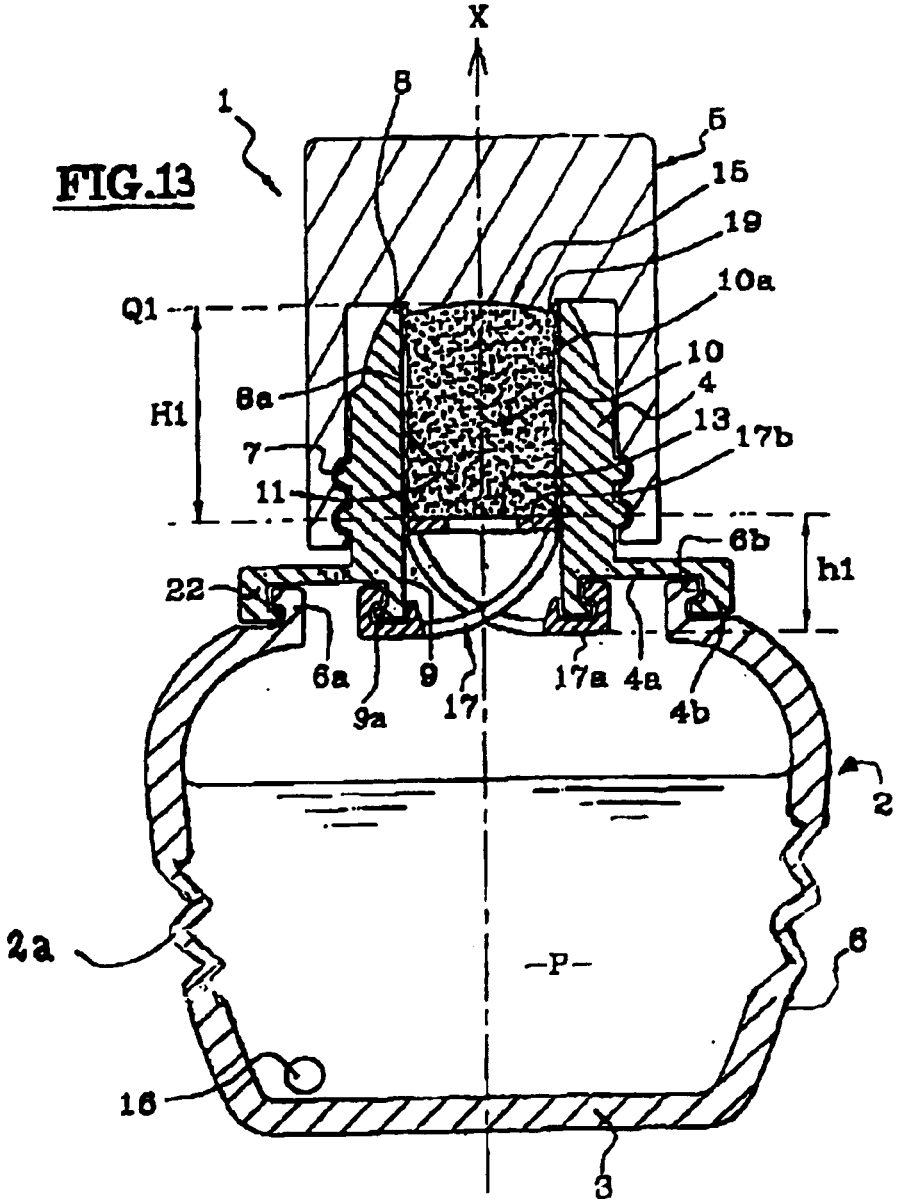

FIG. 5 depicts a longitudinal cross-sectional view of another embodiment of the applicator device according to the invention;

FIGS. 6*a* and 6*b* are cross-sectional side views of the applicator member and support in the expanded position (position of use) and in the compressed position (retracted position), respectively, in accordance with the embodiment of FIG. 5;

FIG. 7 is a side view of another embodiment of the applicator device using an alternative support structure;

FIG. 8 is a side view of an alternative embodiment of the applicator device having a tube for a body;

FIG. 9 is a side view of an alternative embodiment of the applicator device utilizing a one way valve according to one aspect of the invention;

FIGS. 10*a* to 10*e* are side views the applicator member and the support mounted in various ways;

FIGS. 11*a* to 11*g* are side views of various embodiments of the applicator member and of the support according to preferred embodiments of the invention;

FIG. 12 is an isometric view of an alternative embodiment of the applicator device of FIGS. 1 and 2; and FIG. 13 is a cross-sectional side view of an alternative embodiment of the body of the applicator device shown in FIG. 5.

Reference will now be made in detail to the present preferred embodiments of the invention, examples of which are illustrated in the accompanying drawings. Wherever possible, the same reference numbers will be used throughout the drawings to refer to the same or like parts.

FIGS. 1 and 2, to which reference is now made, illustrate a first embodiment of the applicator device 1 according to the invention. This device is in the form of an applicator bottle for a product P of the liquid cream or liquid foundation type and mainly comprises a reservoir 2 including of a body 6, one end of which is closed by an end 3. The other end of the reservoir 2 ends in an attached neck 4 comprising, on its exterior surface, means 7 (of the screw thread or snap-on bead type) to allow the removable fitting of a closure member 5, such as a cap or lid, so as to seal closed an opening 8 which is delimited by the free edge of the neck 4.

The internal wall 8*a* of the attached neck 4 defines an internal cylindrical housing 11, with symmetry of revolution about a longitudinal axis X. An open end 9 of the housing, at the opposite end to the opening 8, includes a bulge 9*a*, which serves to attach a portion 17*a* bearing a support 17 housed entirely inside the housing 11. The neck 4, in the region of the open end 9, has an annular plateau 4*a* extending radially outwards, and the periphery of which has a turned-down edge 4*b*. The turned-down edge 4*b* is fixed, by snap fastening, onto a flange 6*a* which has a radial projection 6*b* formed at the top of the reservoir body 6, at the opposite end to the end 3. Quite evidently, this snap-fastening system could be replaced by any screw-fastening system.

The support 17 is housed in the lower part of the housing 11. According to the exemplary embodiment of FIGS. 1 and 2, the support 17 is formed by a double helix, of which the upper part 17*b*, away from the attachment portion 17*a*, constitutes an axially movable element for attaching an applicator member 10.

In the current embodiment, the applicator member 10 is fixed to the support 17*b* by bonding, welding, crimping (as will be specified when describing FIG. 10*e*) or any other appropriate means.

As is more precisely apparent from FIG. 1, which shows the container in the storage position Q1, the applicator member 10 is mounted so that it can slide inside the neck 4. The applicator member 10 has an applicator surface 15 which is preferably domed slightly outwards. In this storage position, the applicator member 10 is held in place inside the neck 4 by the cap 5. For this purpose, the cap 5 comprises an internal portion 19, of a shape that complements the shape of the applicator surface 15. In this position Q1, the support 17 is compressed. Arranging the internal portion 19 of the cap resting against the application surface 15 and complementing the latter makes it possible to avoid damaging the applicator surface 15 in the storage position. This is the case, in particular, when the applicator surface 15 has a fragile structure such as flocking. Other advantages exhibited by this arrangement will be explained later on in the description.

According to the embodiment considered, the applicator member 10 is in the form of a block of absorbent material of which one end 13, opposite the applicator surface 15, is located significantly above the level of the product P contained in the reservoir 2. This end 13 can be brought into contact with the product P.

Typically, the applicator member 10 has a diameter of between 2 mm and 35 mm, preferably of between 5 mm and 25 mm. Its height, in the uncompressed position (Q2), can vary between 5 mm and 50 mm.

According to another embodiment, the absorbent material that constitutes the applicator member 10 comprises a roughly rigid free end formed, for example, of a frit, a fairly incompressible foam, a woven, a non-woven or a felt.

However, according to a preferred embodiment, the absorbent material constituting the applicator member 10 is preferably formed of an elastically compressible material such as a foam or some other spongy material. It is possible to make the applicator member 10 from an axial series of at least two portions of foam of different compressibilities or densities. The advantages of an arrangement such as this will be detailed later on.

The applicator member 10 may have a cylindrical, frustoconical or prismatic shape and may have a circular, oval, rectangular or polygonal cross section.

In general, the applicator member 10 has open pores or cells, of a mean size of between 200 $\mu$m and 1.5 mm, and preferably between 700 $\mu$m and 1 mm, and more particularly between 0.1 mm and 0.5 mm. As a preference, the cells or pores communicate with each other in all directions.

According to FIG. 1, in the storage position (Q1) illustrated, the applicator member 10 is made of deformable foam, partially compressed and having a height H1. Likewise, the support 17 is compressed and has a height h1. The applicator surface 15 thus lies entirely inside the neck 4. A ball or weight 16 is placed in the reservoir 2 to allow the product P to be mixed.

In FIG. 2, the assembly 1 has had its cap 5 removed. Upon opening, when the material of which the applicator member 10 is made is an elastic foam, the block of foam becomes decompressed, and causes product, previously in contact with the end 13 of the block of foam, to be pumped. After opening, the block of foam is no longer compressed and extends over a height H2. At practically the same time as the decompression of the support 17 over a height h2, there is axial expansion of the applicator member 10. The applicator surface 15 therefore emerges out of the neck 4 by a distance C, above the free edge delimiting the opening 8, and occupies a position Q2 known as the position of use. The applicator surface 15 has a profile the shape of which is chosen according to the profile of the surface that is to be treated. As appropriate, the applicator surface 15 may be covered with a permeable coating, of the textile, perforated plastic, or felt type and/or is covered with flocking. In this case, the flocking may include bristles of different diameters and/or of different kinds and/or of different heights or of a mixture of such bristles.

To use the applicator container according to the invention, the user removes the cap 5 and this causes the block of foam 10 forming the applicator 10 and the support 17 to decompress so that the applicator surface 15 emerges out of the neck 4. It will be noted that, on moving from the storage position Q1 to the position of use Q2, the height of the applicator member 10 increases to a lesser extent than does the height of the support 17. This can be expressed as follows: $(h2-h1)>(H2-H1)$. The difference in height variation of the two parts is due to the fact that the compressibility of the supports 17 is greater than the compressibility of the applicator member 10. The decompression of the applicator member 10 is accompanied by a pumping of product P towards the applicator surface 15. The applicator member 10 is thus saturated with product P and can now be used. The device, even inverted head down for applying product, is perfectly sealed because of the presence of a portion of the applicator 10, which portion is saturated with product, in the neck 4 of the bottle. It should be noted that in such an embodiment, bringing the applicator 10 into contact with the product occurs by inverting the unit, shaking it, or each time movement is brought about, for example by carrying the unit around in a handbag.

The operation of applying a dose of product P to the surface that is to be treated is as follows. The user applies the applicator surface 15 to the surface to be treated, and exerts pressure on the applicator 10 according to the desired dose of product P, which pressure causes partial compression of the applicator member 10 and causes a dose of product P to be let out. Excessive pressure, which could give rise to excess product being let out, with the risk of making a mess, is compensated for by the support 17. In effect, the support 17 therefore limits the pressure exerted, by itself becoming compressed. In extremis, the compression of the support 17 causes the applicator surface 15 to drop down to the level of the free edge 8 of the neck, without any increase in compression of the applicator member 10.

All that then remains, having released the pressure exerted on the applicator unit, is for the product P to be spread out using the applicator surface 15. The release of the pressure of the applicator on the treated surface, particularly on the skin is accompanied by the pumping of product. The applicator is immediately ready for further application. Thus, product is spread out by passing the applicator surface 15 over the surface that is to be treated, by simple capillary contact, so as to draw the product out in the form of a film under the action of the affinity for product exerted between the applicator surface 15 and the surface that is to be treated, and this can be done without noticeably exerting the slightest bit of pressure on the applicator unit.

Figure 3A:
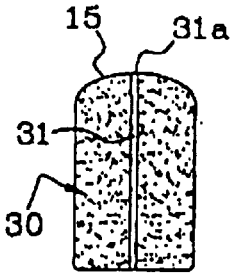
Figure 3B:
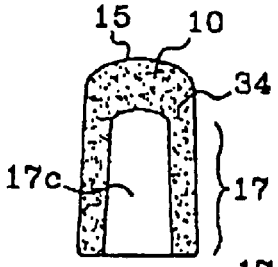
Figure 3C:
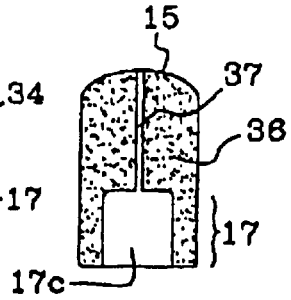
Figure 3D:
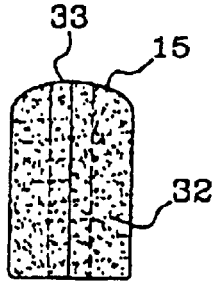

FIGS. 3*a* and 3*d* depict two alternative forms of an applicator member 30 and 32, which can replace the applicator member 10 of FIGS. 1 and 2. FIG. 3*a* shows an applicator member 30, the applicator surface 15 of which is in the form of a dome. The applicator member 30 has a small-cross-section distribution duct 31 passing through it's entire height. This arrangement makes it possible to increase the rate of delivery of the dose of product P at the time of application. In the storage position, the free end 3*a* is closed by compression using the cap.

According to the embodiment of FIG. 3*d*, the delivery rate of the applicator member 32 can be adjusted by making one or more contiguous or non-contiguous axial slits 33. These slits 33 may be arranged in the shape of a cross or of a star and are capable of encouraging the product P to be conveyed towards the applicator surface 15. The presence of dispensing ducts or slits 33 also encourages greater saturation of the applicator member 10 with product.

According to another embodiment, the support and the applicator member form a single structure. Thus, as embodied herein and shown in FIG. 3*b*, an end piece 34 made of elastic foam is formed as a single piece, an upper first portion of which constitutes the applicator member 10, and a lower second portion of which constitutes the support 17.

The first portion 10 comprises a domed applicator surface 15. The second portion 17 is of slightly frustoconical shape, having, on the inside, a recess 17*c* opening towards the reservoir. The cross-sectional area of the applicator portion 10 is greater than the cross-sectional area of the support-forming means 17. What this structure means is that the compressibility of the support 17 is greater than the compressibility of the applicator member 10.

FIG. 3*c* shows an applicator end piece 36 similar to the end piece 34 of FIG. 3*b*. By comparison with the end piece 34, the compressibility of the support 17 of the end piece 36 is lower, because its height is shorter by comparison with the support 17 of FIG. 3*b*. As in the embodiment of FIG. 3*a*, the applicator portion 10 has an axial distribution duct 37 passing through it.

FIGS. 4*a* to 4*c* show a method of fitting an end piece 38 incorporating an applicator member 10 and support 17, which end piece is similar to the one shown in FIG. 3*b*. This arrangement of the two elements 10, 17 as an integrated unit displays one particularly preferred embodiment of the invention. Specifically, this embodiment is particularly advantageous, both from the economic point of view and from the technical point of view. Thus, this embodiment entails manufacturing just one part made of foam. Likewise, it is possible according to this embodiment for the applicator member 10 incorporating the support 17 to be mounted in the housing 11 in a single mounting step.

FIGS. 4*a*–4*c* show that the lower part of the housing 11 is equipped with a series of longitudinal ribs 8*a* and cuts 8*b* distributed uniformly over a portion of the internal wall delimiting the housing 11. FIG. 4*a* shows the unit in the storage position. FIG. 4*b* illustrates the position of use. An annular space 8*c* is defined near the orifice 8, intended to take any surplus product likely to be expelled as the cap 5 is fitted (see FIG. 4*a*). At the same time, the profile 19 of the cap 5 gives rise to radial deformation, at the top of the applicator member 10, pressing in this region in a sealed manner against the internal wall of the housing 11. The surplus product can then be discharged to the reservoir, via the grooves 8*b* and through the permeable wall of the support 17. Alternatively, a portion of the lateral wall of the support 17 may have longitudinal grooves distributed uniformly about its periphery.

These grooves may also have a helical shape, slowing the rate at which excess product is discharged and possibly acting as micro-reserves of product, for a second application of product.

As visible in FIG. 5, the applicator member and the support may comprise a stack of blocks of foam 10, 17', 17" bonded together, of different natures and/or densities and/or thicknesses, particularly of a compressibility that increases from the top downwards. Thus, the product retention capability varies. They thus form a single end piece 39. According to the current example, the applicator member 10 includes a frit or of a fairly rigid foam. The annular segments 17' and 17" constituting the support 17 are formed of an elastic foam, the size of the cells of the lower segment 17" being greater than the size of the cells forming the upper segment 17'. It is thus possible to create a gradient for the compressibility and for the concentration of product when filling or emptying the cells during application.

It is thus possible to alter the fill rate of the applicator member 10 and its delivery rate. Furthermore, this characteristic makes it easier to adapt the applicator to suit the rheology of the product. Alternatively, a block of foam may be used in conjunction with a block or several blocks of another material capable of pumping the product P by capillary action or by a surface tension effect. By way of example, use is made of a portion 17', 17" of compressible foam, in combination with a block 10 of polyvinyl chloride or ethylene vinyl acetate frit or with a felt.

According to the embodiment of FIG. 5, the end 3 of the reservoir 2 has an elastically deformable portion 3*a* of the elastomeric type, domed outwards. This arrangement makes it possible, by pressing on the portion 3*a*, to temporarily raise the internal pressure of the container to encourage the applicator member to become impregnated with product P via the support 17. This arrangement is useful in the case of products of high viscosity or in the form of gel. The deformable portion 3*a* may be an attached part, it being possible for it to be screwed, bonded, snap-fastened, welded, crimped or produced by two-shot injection moulding. Alternatively, as shown in FIG. 13, instead of elastically deformable portion 3*a*, a bellows portion 2*a* may be used instead.

With reference to FIGS. 4*a*, 4*b*, and 5 it can be seen that the support 17 is mounted on a perforated transverse wall 13*b* comprising capillary passages 13*a* capable of holding a determined dose of product, by capillary action. Thus, when the unit is in use, the applicator member always becomes laden with a constant dose of product, regardless of the method of loading (compression/decompression of the block of foam; compression of the product reservoir).

Thus, before removing the cap with a view to applying product, the user presses once or more times on the end 3*a*, and this has the effect of moving the product P in contact with the internal walls (defining the recess 17*c*) of the end piece 39 and of at least partially compressing the applicator member 10 and the support 17. By releasing the pressure exerted on the end 3*a*, the applicator member 10 and the support 17 decompress, thus causing product to be pumped. All that remains is for the cap to be removed, with a view to use, in a similar way to the way described with reference to FIGS. 1 and 2. The pumping of product also occurs when the cap is opened, by freeing the applicator surface 15 which initially, in the storage position, is constrained inside the housing 11. Likewise, the decompression which follows each application allows a certain amount of product to be pumped into the applicator member 10. This embodiment is particularly well-suited to products in the form of gel, fluid products with higher viscosities, or thixotropic products.

FIG. 6*a* shows the end piece 39 of FIG. 5, ready for use, in the deployed position. The supports 17' and 17" are more or less saturated with product, which product is conveyed, at the time of application of the applicator surface 15 onto the surface that is to be treated, through the applicator member 10. The total height of end piece 39 is H2+h2.

FIG. 6*b* shows the element 39 of FIG. 5 in the storage position. It can be seen that the combined height h1 of the supports 17' and 17" is reduced by more than half by comparison with the initial value h2. The cells that constitute the supports 17', 17" are compressed, ready to pump product as they relax.

FIG. 7 depicts an alternative form of the embodiment of FIGS. 1 and 2. According to FIG. 7, a foam applicator member 10 is mounted removably on the support structure 17*b* of the support 17. For this purpose, its lower part has a cylindrical recess 10*b* which can be slipped snugly onto a tube 17*d* emerging in the continuation of the upper part 17*b* of the support 17. Thus, the applicator member 10 can be removed to clean it, or alternatively can be replaced by another applicator member with different characteristics suited to a different type of product or to a different mode of application.

According to the embodiment illustrated in FIG. 8, a reservoir of product is formed by a compressible tube 2, the bottom of which is formed by a closure line 3. The tube has a neck 6*a* on which is mounted, by screw-fastening means, a tubular element 4 defining a cylindrical housing 11 ending in a free edge which defines the opening 8. The lower part of the housing 11 is equipped with an internal annular projection 13*b* to which is attached an end piece 36 made of elastic foam, similar to the element 36 illustrated in FIG. 3*c*. The element 36 is made up of a portion 10 forming the applicator member and a recessed portion 17 constituting the support. The applicator member 10 has, passing through it, a central distribution duct 37 and emerges, in the position of use depicted in FIG. 8, towards the outside of the housing 11. A cap 5 is provided to close the opening 8, so as, by compressing the support 17 and the applicator member 10, to position the applicator surface 15 inside the housing 11. The opening 8 may be closed by screw-fastening means 41, 42 or by any other appropriate means. To ensure gentle contact and improve the seal in the storage position, an elastically deformable element 5*a*, particularly one made of foam, is provided on the internal face of the cap 5 which face is intended to come into contact with the applicator surface 15 and dose the distribution duct 37. The elastically deformable element 5*a* may be saturated with solvent, to minimize the extent to which the applicator member 10 dries out.

FIG. 9 illustrates an alternative form of the embodiment of FIGS. 1 and 2. In this embodiment, impregnation of the applicator member 10 is made easier by the presence of a one-way valve 43 arranged between the reservoir 2 and the support 17. In this case, the reservoir 2 is deformable, contracting as product is emptied. While the applicator member 10 is in compression, the valve 43 prevents product from being delivered to the tube. The applicator member 10 may be flexible or semi-rigid. Following prior compression of the support 17, followed by their decompression, a temporary partial vacuum is pulled in the space 44 defined between the valve 43 and the applicator member 10, causing a dose of product to be drawn in. Further compression of the support creates an internal pressure encouraging the applicator member 10 to become impregnated with product, this member then being ready to apply the product at the desired point.

Figure 10A:
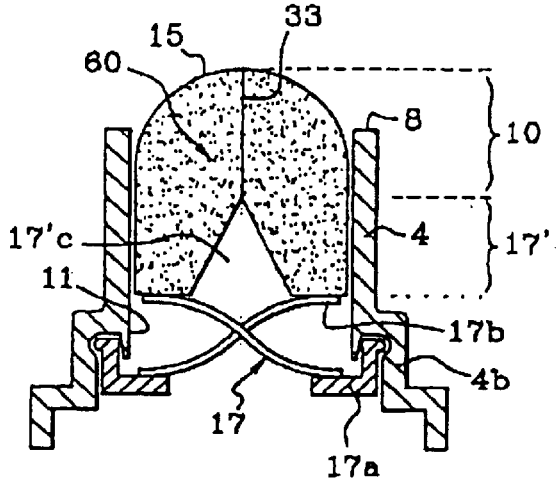

FIGS. 10*a* to 10*e* illustrate various profiles of the applicator member 10 and of the support-forming means 17, and the method of assembling them. FIG. 10*a* shows an end piece 60 comprising an upper part 10 constituting the applicator member and a lower part 17' acting as support. This end piece 60, made from a single block of foam, is mounted on a helical spring 17 constituting an additional support. The helical spring 17 has a structure similar to the structure of the spring 17 shown in FIGS. 1 and 2. Thus, the helical spring 17 is secured to a base 17*a*, mounted stationary on the lower part 4*b* of the housing 11. The fact of combining the support 17' with additional means 17 makes it possible, on the one hand, to increase the travel between the retracted position and the position of use of the applicator surface 15. Furthermore, this arrangement makes it possible to increase the smoothness of application. This arrangement also makes it possible to regulate the amount of product pumped, charging the applicator member 10, and the dose and delivery rate of product restored when applying the surface 15 to the surface that is to be treated.

It will be noted that the moving end 17*b* of the support comprises a recess 17'*c*, of conical shape, the bottom portion of the conical shape facing towards the reservoir. Thus is defined a zone which is axially deformable in a progressive way, according to the bearing force exerted on the applicator surface 15. Product can thus be restored to the surface that is to be treated accurately, in such a way as to adapt the delivered dose of product to the user's needs. Any release of excess product may be avoided. To increase the product delivery rate, at least one axial slit 33 passes through the applicator member 10, from the vertex of the cone 17'*e* towards the applicator surface 15. The width of this slit can vary according to the rheological properties of the product and the desired delivery rate. The structure of the end piece 60 is such that the cross-sectional area of the support 17' is smaller than the cross-sectional area of the applicator member 10.

Figure 10B:
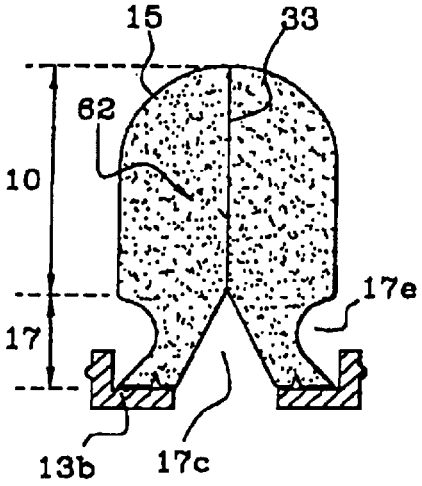

FIG. 10*b* illustrates an end piece 62 which differs from the embodiment of the end piece 60 shown in FIG. 10*a*. It differs from the embodiment of FIG. 10*a* in the fact that the support includes a single part 17 comprising, apart from the conical recess 17*c*, a wide external annular throat 17*e*, which means that the cross section of the support 17' is markedly smaller than the cross-sectional area of the applicator member 10. This structure gives the end piece 62 similar properties to the properties of the end piece 60 of FIG. 10*a*.

Figure 10C:
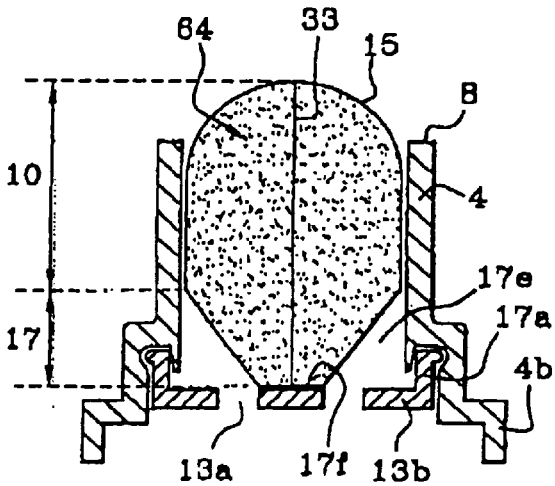

FIG. 10*c* illustrates an end piece 64 similar in embodiment to the embodiment of the end piece 62 shown in FIG. 10*b*. It differs from the embodiment of FIG. 10*b* in that the support includes a frustoconical portion 17, the cross section of which decreases towards the reservoir. An end portion 17*f* forms a heel, fixed to a perforated plateau 13*b* which has a number of passages 13*a*. Like the embodiment of FIGS. 4*a* and 4*b*, the perforated plateau 13*b* is secured to a base 17*a* mounted on the lower part 4*b* of the housing 11.

Figure 10D:
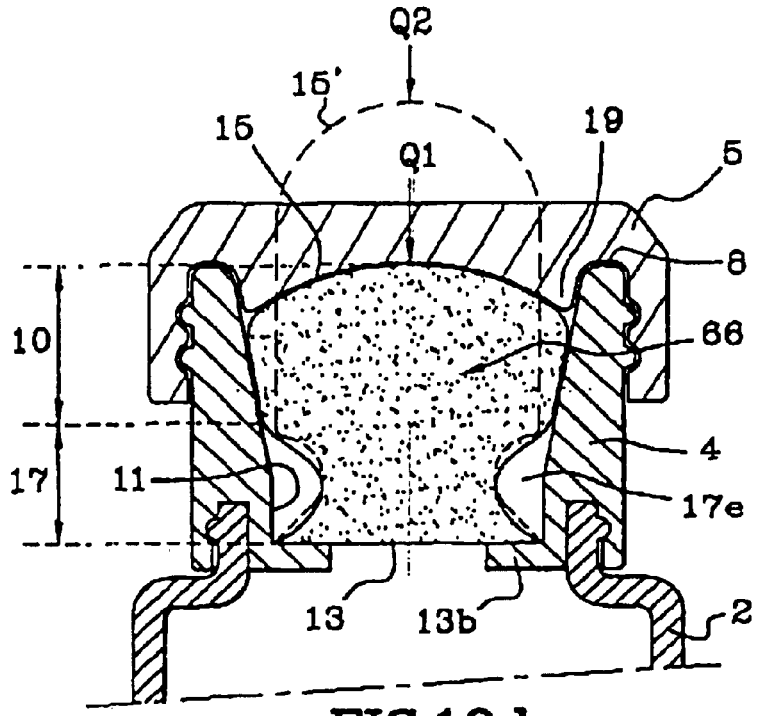

FIG. 10*d* illustrates an end piece 66 similar to the embodiment of the end piece 62 illustrated in FIG. 10*b*, mounted in the storage position (in continuous line) and in the position of use (in broken line). It essentially differs from the embodiment of FIG. 10*b* in that the housing 11 has a frustoconical shape, flared outwards. It can be seen that compressing the part forming the applicator member 10, under the effect of the compression exerted by the profile 19 of the cap 5, causes sealed contact, in the storage position, between the internal wall of the housing 11 and the periphery of the applicator member 10.

Figure 10E:
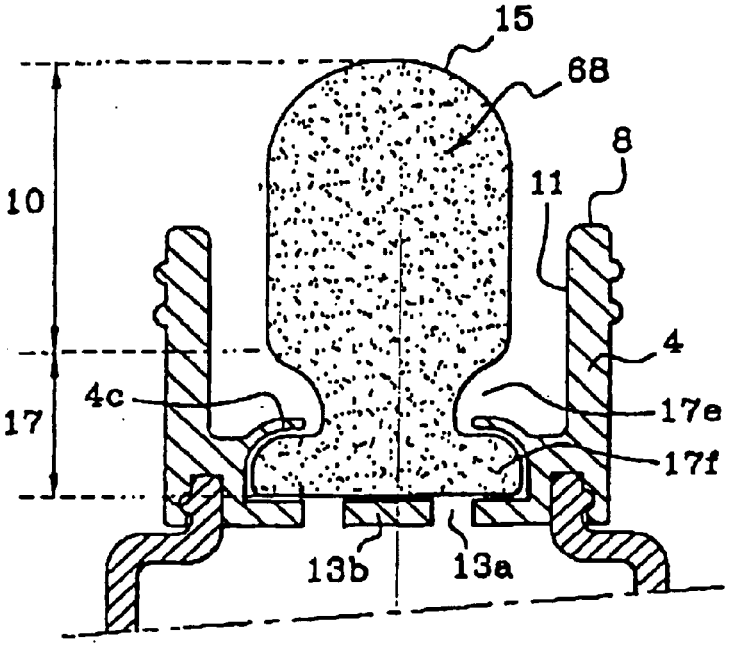

FIG. 10*e* illustrates an end piece 68 similar to the embodiment of the end piece 66 of FIG. 10*d*, shown in the position of use. It differs from the structure of the end piece 66 described hereinabove in that the part forming the support 17 terminates, at the reservoir end, in a broad heel 17*f*, this part being separated by a zone of smaller cross section 17*e* from the part forming the applicator member 10. The heel 17*f* is fixed to a perforated plateau 13*b* by knocking over, in the hot state (otherwise known as crimping) an initially cylindrical portion 4*c* so that it bends radially over towards the inside onto the peripheral part of the heel 17*f*.

FIGS. 11*a* to 11*g* illustrate various alternative forms in which the applicator member 10 is made as a single piece with the support 17, particularly of open-cell foam. All these alternative forms have an attachment heel 17*f* forming the base of the support 17.

Figure 11A:
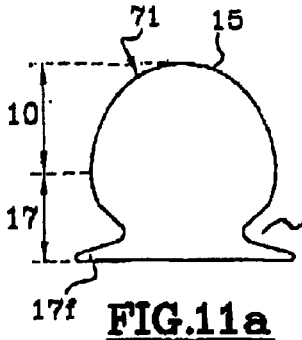

In FIG. 11*a*, an end piece 71 is formed by an applicator member 10 and support 17, in a similar way to the embodiment of FIG. 10*d*. Heel 17*f* is intended to be secured to a fixed support, particularly of the perforated plateau type 13*b*, as illustrated in FIG. 10*e*. A broad annular throat 17*e* defines a region of smaller cross-section, with compressibility lower than the compressibility of the applicator member 10.

Figure 11B:
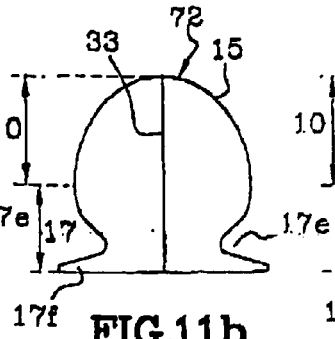

The end piece 72 shown in FIG. 11*b*, differs from the end piece 71 of FIG. 11*a* in that it comprises an axial slit 33, making it possible to increase the product delivery rate, particularly in the case of a product in gel form or a viscous product.

Figure 11C:
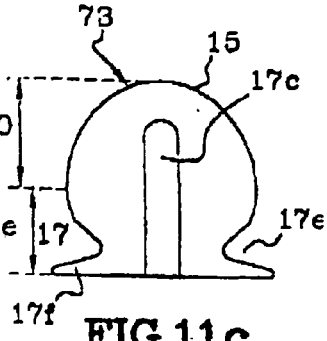

The end piece 73 shown in FIG. 11*c* differs from the end piece 71 of FIG. 11*a* in that it comprises a recess 17*c* in the form of a blind duct for bringing the product closer to the applicator surface 15 and increasing the compressibility of the applicator member 10 at the same time as the compressibility of the support 17. The unit can, in this way, be made gentler in application.

Figure 11D:
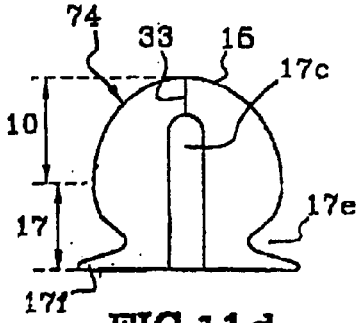

The end piece 74 shown in FIG. 11*d* differs from the end piece 73 of FIG. 11*c* in that the recess 17*c* is continued by a slit 33 opening onto the applicator surface 15. This arrangement allows for gentler application, while at the same time increasing the product delivery rate at the time of application.

Figure 11E:
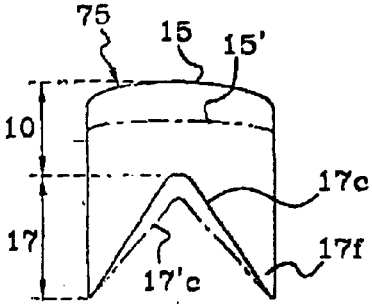

The end piece 75 shown in FIG. 11*e* comprises a support 17 equipped with a conical recess 17*c*, in a similar way to the embodiment illustrated in FIG. 10*a*. In this figure, a continuous line shows a configuration corresponding to the application position. In FIG. 11*e*, the retracted position of the applicator surface referenced 15' is depicted in dotted line. Another continuous line shows the shape of the conical recess 17*c* in the position of use and another dotted line 17'*c* shows it in the storage position. Compressing the support 17 requires a gradual application of force, making it possible to gradually release the product, according to the bearing force exerted on the applicator surface 15.

Figure 11F:
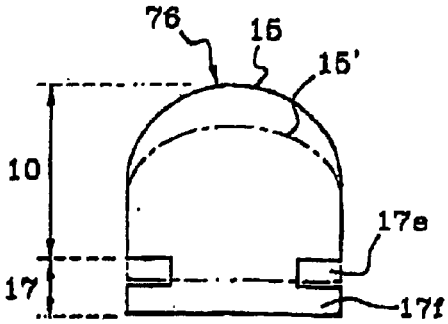

The end piece 76 shown in FIG. 11*f* is an alternative form of the end piece 71 of FIG. 11*a*, in which the annular throat 17*e* and the heel 17*f* have different shapes, but fulfil the same functions. In a similar way to FIG. 11*e*, the end piece 76 is shown in the position of use (in continuous line) and, respectively, in the storage position (in dotted line).

Figure 11G:
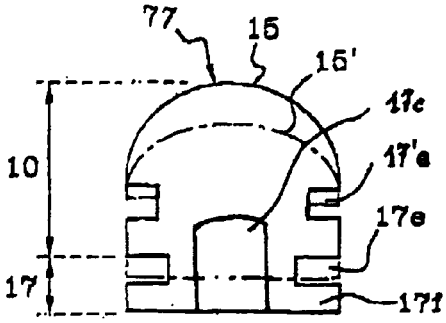

The end piece 77 shown in FIG. 11*g* is an alternative form of the end piece 76 of FIG. 11*f*, in which an additional annular throat 17'*e* has been made above the throat 17*e*. The support 17 is equipped with a cylindrical recess 17*c* opening towards the base of the support. It is clearly understood that the throats 17*e* and 17'*e* can be identically or differently shaped, depending on the desired compressibility of the end piece. As necessary, a number of similar annular throats can be produced, the shape of which may be identical or different. In a similar way to FIG. 11*f*, the end piece 77 is shown in a position of use (in continuous line) and, respectively, in a storage position (in dotted line).

FIG. 12 depicts another embodiment of a packaging and applicator unit comprising a reservoir 2 surmounted by a neck 4. Here, the reservoir includes a body 6 of prismatic shape. The neck has a roughly square cross section. Inside it is a housing 11 in which is mounted, in the way described previously, a support (not visible) surmounted by an applicator member 10. In the open position as illustrated in FIG. 12, the applicator surface 15 emerges towards the outside. The difference by comparison with the embodiments of FIGS. 1 and 2 (or 4*a* and 4*b*) is that the closure means is not a removable cap but a removable lid 50 pivoting about a hinge 45, particularly a film hinge, attached to a portion of the free end 8 of the neck. The lid 50 comprises a seal 19, particularly an elastic seal, which can be placed on the free end 8 around the opening of the housing 11. The lid 50 comprises a clasp 46, located on the opposite side of the hinge 45, and capable, upon closure, of collaborating with a complementary element 47 located on a portion of the free end 8 opposite the hinge.

Upon closure of the lid 50, at least the support 17 is compressed (and, as appropriate, the applicator member 10 is also at least partially compressed) so that the applicator surface 15 finds itself entirely housed inside the housing 11. As the lid is opened, by virtue of the elasticity of the support 17 and the axial mobility of the applicator member 10, the applicator surface 15 finds itself in the position of use, appropriately laden with product, as described earlier.

In this case, as incidentally was the case in the embodiments described earlier, the reservoir may be made of metal, glass or thermoplastic material chosen from polyethylenes, polypropylenes, polyvinyl chlorides, polyethylene terephthalates, etc. The other parts of the device, and its operation, are as described previously.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An applicator device for a liquid product, the applicator comprising:

a reservoir for containing the liquid product, the reservoir having an opening;

a removable closure member for sealably closing the opening;

an applicator member provided in the reservoir, the applicator member including a first end portion configured to be impregnated with the product and a second end portion, opposite the first end portion, the second end portion including a product application surface and being axially moveable between a first position wherein the second end portion extends out of the reservoir through the opening, and a second position wherein the second end portion is at least substantially contained in the reservoir, the applicator member including at least one block formed of at least one absorbent material capable of being at least partially compressed; and an elastically compressible support supporting the applicator member in the reservoir, the support having a compressibility greater than the compressibility of the applicator member.

2. The applicator device of claim 1, wherein the application surface is at least substantially contained in the reservoir when the applicator member is in the second position.

3. The applicator device of claim 1, wherein the applicator member has a compressibility such that the block becomes compressed during at least one of application of product via the product application surface and placement of the applicator member in the second position.

4. The applicator device of claim 1, wherein the support includes an element that is distinct from the applicator member.

5. The applicator device of claim 1, wherein said support includes a spring.

6. The applicator device of claim 5, wherein the spring is formed of one of plastic and metal.

7. The applicator device of claim 1, wherein the support includes at least one block of an elastically deformable material.

8. The applicator device of claim 7, wherein the support includes a block of foam.

9. The applicator device of claim 8, wherein the block of foam includes one of open cells and semi-open cells.

10. The applicator device of claim 7, wherein the at least one block of elastically deformable material of the support is secured to the applicator member.

11. The applicator device of claim 1, wherein the applicator member is attached to the support.

12. The applicator device of claim 11, wherein the applicator member is attached to the support by one of bonding, welding, and crimping.

13. The applicator device of claim 1, wherein the support has at least one portion integral with the applicator member, said at least one portion being configured to have greater compressibility than the remainder of the applicator member.

14. The applicator device of claim 13, wherein the at least one portion includes an area with a cross-section smaller than a cross-section of the remainder of the applicator member.

15. The applicator device of claim 1, wherein the difference in compressibility between the applicator member and the support results from the presence of an indentation formed on the applicator member on at least part of its periphery.

16. The applicator device of claim 1, wherein the difference in compressibility between the applicator member and the support results from the presence of a central recess formed on the applicator member and extending over at least part of the height of the applicator member.

17. The applicator device of claim 1, wherein the applicator member includes at least one passage passing through it.

18. The applicator device of claim 17, wherein the passage is in the form of one of a slit and a fine channel.

19. The container of claim 17, wherein the passage terminates adjacent to the product application surface.

20. The applicator device of claim 1, wherein the applicator member and the support are arranged inside a housing provided at least partially inside a neck of the reservoir, the housing being configured to be in fluid communication with the liquid product in the reservoir.

21. The applicator device of claim 20, wherein the housing is cylindrical in shape.

22. The applicator device of claim 20, wherein the housing has a cross-section having a shape of one of circular, oval, rectangular and polygonal.

23. The applicator device of claim 20, wherein an internal side wall of the said housing includes at least one longitudinal groove.

24. The applicator device of claim 20, further comprising a perforated element separating the housing from the liquid product in the reservoir.

25. The applicator device of claim 24, wherein the perforated element is in the form of one of a grating, a sieve, and a valve.

26. The applicator device of claim 24, wherein the perforated element is configured to provide one-way flow towards the product application surface.

27. The applicator device of claim 1, wherein the product application surface has a concave profile.

28. The applicator device of claim 20, wherein the applicator member includes a side wall configured to make sealed contact with an internal wall of the housing in at least in the second position.

29. The applicator device of claim 28, wherein the side wall of the applicator member includes at least one longitudinal groove.

30. The applicator device of claim 1, wherein the product application surface has a convex profile.

31. The applicator device of claim 1, wherein the product application surface includes at least one of a dome, a single bevel, and a double bevel.

32. The applicator device of claim 1, wherein the applicator member is formed from a block of one of open-cell foam and semi-open cell foam.

33. The applicator device of claim 1, wherein the applicator member includes, near the product application surface, one of a rigid foam, a perforated element, a woven, a non-woven, a felt, and a mesh.

34. The applicator device of claim 1, wherein the removable closure member is configured such that sealable closing of the opening causes the second end portion of the applicator member to move from the first position to the second position.

35. The applicator device of claim 1, wherein the removable closure member has a profile configured to cooperate in a sealed fashion with a free edge defining the opening.

36. The applicator device of claim 1, wherein the a portion of the closure member has a shape substantially the same as the shape of the product application surface.

37. The applicator device of claim 1, wherein at least one of the support and the applicator member has open pores or cells of a mean size ranging from 50 $\mu$m to 1.5 mm.

38. The applicator device of claim 37, wherein at least one of the support and the applicator member has open pores or cells of a mean size ranging from 7001 $\mu$m to 1 mm.

39. The applicator device of claim 38, wherein at least one of the support and the applicator member has open pores or cells of a mean size ranging from 0.1 mm to 0.5 mm.

40. The applicator device of claim 1, wherein the reservoir includes a compressible body.

41. The applicator device of claim 40, wherein the compressible body is a deformable tube.

42. The applicator device of claim 40, wherein said body includes at least one elastically deformable portion.

43. The applicator device of claim 42, wherein the elastically deformable portion is a bellows portion.

44. The applicator device of claim 42, wherein the elastically deformable portion is a diaphragm portion.

45. The applicator device of claim 1, wherein the applicator member and the support are mounted on the reservoir via an intermediate member.

46. The applicator device of claim 45, wherein the support is mounted on the intermediate member by one of snap-fastening, screwing, bonding, welding, and crimping.

47. The applicator device of claim 1, wherein at least one of the applicator member and the support is made of foam.

48. The applicator device of claim 47, wherein the foam is chosen from polyurethane, polyethylene, polyvinyl chloride, polyether, polyester, natural rubber, and synthetic rubber foams.

49. The applicator device of claim 1, further comprising a mixing element inside the reservoir so as to encourage the mixing of the product and to make it easier for the applicator member to become laden with the product.

50. The applicator device of claim 49, wherein the mixing element is at least one of a ball and a small weight.

51. The applicator device of claim 1, wherein the applicator member is removably mounted in the reservoir.

52. The applicator device of claim 1, wherein the closure member includes an element configured to engage, when the reservoir is closed, the product application surface.

53. The applicator device of claim 52, wherein the element is a block of foam.

54. The applicator device of claim 1, wherein the compressibility of the support is approximately two to four times greater than the compressibility of the applicator member.

55. The applicator device of claim 1, wherein the closure member is one of a screw-on cap and a snap-on cap.

56. The applicator device of claim 1, wherein the closure member is a lid hinged to the opening.

57. The applicator device of claim 56, wherein the lid is hinged to the opening by a film hinge.

58. The applicator device of claim 1, wherein the reservoir contains the product and the product is a cosmetic product.

59. The applicator device of claim 58, wherein the cosmetic product is one of a nail varnish, a liquid lipstick, a make-up remover, a nail varnish remover, a liquid foundation, a cream, a lotion, and an oil.

60. The applicator device of claim 59, wherein the cosmetic product is in the form of a gel.

61. The applicator device of claim 1, wherein the reservoir contains the product and the product is one of a glue, a correction fluid, and a stain remover.

62. A method of applying a cosmetic product, comprising:

providing the applicator device of claim 1 with a cosmetic product in the reservoir;

pressing on the product application surface of the applicator member to supply the cosmetic product to the applicator member; and placing the product application surface in contact with an area to be treated to apply the cosmetic product.

63. The applicator device of claim 1, wherein when the second end portion is in the first position, the application member is in flow communication with the reservoir.

64. The applicator device of claim 1, further comprising a liquid cosmetic product, wherein the reservoir contains the liquid cosmetic product.

65. An applicator device for a liquid product, the applicator comprising:

a reservoir for containing the liquid product, the reservoir having an opening;

a removable closure member for sealably closing the opening;

an applicator member provided in the reservoir, the applicator member including a first end portion configured to be impregnated with the product and a second end portion, opposite the first end portion, the second end portion including a product application surface and being axially moveable between a first position wherein the second end portion extends out of the reservoir through the opening, and a second position wherein the second end portion is at least substantially contained in the reservoir, the applicator member including at least one block formed of at least one absorbent material capable of being at least partially compressed; and an elastically compressible support supporting the applicator member in the reservoir, the support having a compressibility greater than the compressibility of the application member;

wherein the support includes a stack of at least two blocks of elastically deformable material, the stack having a compressibility that is greater at an end of the stack adjacent the reservoir than at an opposite end of the stack.

66. An applicator device for a liquid product, the applicator comprising:

a reservoir for containing the liquid product, the reservoir having an opening, and an absorbent member provided in fluid communication with the reservoir, the absorbent member comprising at least two portions, a first application portion configured to apply the liquid product to a surface to be treated, and a second support portion configured to elastically support the first portion, wherein the first portion comprises one of a frit and a foam and has a different density than the second portion, wherein the absorbent member comprises a face that faces toward the reservoir, the face being positioned with respect to the reservoir so as to be loaded with product from the reservoir, wherein the support portion has a greater compressibility than a compressibility of the application portion.

67. The applicator device of claim 66, further comprising a removable closure member for sealably closing the opening.

68. The applicator device of claim 66, wherein the first and second portions are integrally formed.

69. The applicator device of claim 66, wherein at least one of the support portion and the application portion has open pores or cells of a mean size ranging from 50 $\mu$m to 1.5 mm.

70. The applicator device of claim 69, wherein at least one of the support and the applicator member has open pores or cells of a mean size ranging from 700 $\mu$m to 1 mm.

71. The applicator device of claim 70, wherein at least one of the support and the applicator member has open pores or cells of a mean size ranging from 0.1 mm to 0.5 mm.

72. The applicator device of claim 66, wherein the reservoir includes a compressible body.

73. The applicator device of claim 72, wherein the compressible body is a deformable tube.

74. The applicator device of claim 72, wherein said body includes at least one elastically deformable portion.

75. The applicator device of claim 66, wherein the application portion of the absorbent member is movable between a first position wherein the application portion extends out of the reservoir through the opening and a second position, wherein the application portion is at least substantially contained in the reservoir.

76. The applicator device of claim 66, wherein the support portion is attached to the application portion.

77. The applicator device of claim 66, wherein the support portion includes at least one block of an elastically deformable material.

78. The applicator device of claim 77, wherein the support portion includes a block of foam.

79. The applicator device of claim 78, wherein the block of foam includes one of open cells and semi-open cells.

80. The applicator device of claim 66, wherein the support portion includes a recessed portion.

81. The applicator device of claim 80, wherein the application portion includes a central passage connecting with the recessed portion of the support portion.

82. The applicator device of claim 66, wherein the absorbent member includes a central passage through it.

83. The applicator device of claim 66, wherein the reservoir contains the liquid product and the liquid product is a cosmetic product.

84. An applicator device for a liquid product, the applicator comprising:

a reservoir for containing the liquid product, the reservoir having an opening, and an absorbent member provided in fluid communication with the reservoir, the absorbent member comprising at least two portions, a first application portion configured to apply the liquid product to a surface to be treated, and a second support portion configured to elastically support the first portion, wherein the first portion has a different density than the second portion, wherein the second support portion includes a stack of at least two blocks of elastically deformable material, the stack having a compressibility that is greater at an end of the stack adjacent the reservoir than at an opposite end of the stack adjacent the application portion.

85. An applicator device for a liquid product, the applicator comprising:

a reservoir for containing the liquid product, the reservoir having an opening;

a removable closure member for sealably closing the opening;

an applicator member provided in the reservoir, the applicator member including a first end portion configured to be impregnated with the product and a second end portion, opposite the first end portion, the second end portion including a product application surface and being axially moveable between a first position wherein the second end portion extends out of the reservoir through the opening, and a second position wherein the second end portion is at least substantially contained in the reservoir, the applicator member including at least one block formed of at least one spongy material; and an elastically compressible support supporting the applicator member in the reservoir, the support having a compressibility greater than the compressibility of the applicator member.

86. The applicator device of claim 85, wherein the applicator member has a compressibility such that the block becomes compressed during at least one of application of product via the product application surface and placement of the applicator member in the second position.

87. The applicator device of claim 85, wherein the support includes an element that is distinct from the applicator member.

88. The applicator device of claim 85, wherein said support includes a spring.

89. The applicator device of claim 88, wherein the spring is formed of one of plastic and metal.

90. The applicator device of claim 85, wherein the support includes at least one block of an elastically deformable material.

91. The applicator device of claim 90, wherein the support includes a block of foam.

92. The applicator device of claim 91, wherein the block of foam includes one of open cells and semi-open cells.

93. The applicator device of claim 90, wherein the at least one block of elastically deformable material of the support is secured to the applicator member.

94. The applicator device of claim 85, wherein the applicator member is attached to the support.

95. The applicator device of claim 94, wherein the applicator member is attached to the support by one of bonding, welding, and crimping.

96. The applicator device of claim 85, wherein the support has at least one portion integral with the applicator member, said at least one portion being configured to have greater compressibility than the remainder of the applicator member.

97. The applicator device of claim 85, wherein the difference in compressibility between the applicator member and the support results from the presence of an indentation formed on the applicator member on at least part of its periphery.

98. The applicator device of claim 85, wherein the applicator member includes at least one passage passing through it.

99. The applicator device of claim 98, wherein the passage terminates adjacent to the product application surface.

100. The applicator device of claim 85, wherein the applicator member and the support are arranged inside a housing provided at least partially inside a neck of the reservoir, the housing being configured to be in fluid communication with the liquid product in the reservoir.

101. The applicator device of claim 100, further comprising a perforated element separating the housing from the liquid product in the reservoir.

102. The applicator device of claim 101, wherein the perforated element is configured to provide one-way flow towards the product application surface.

103. The applicator device of claim 85, wherein the applicator member is formed from a block of one of open-cell foam and semi-open cell foam.

104. The applicator device of claim 85, wherein the applicator member includes, near the product application surface, one of a rigid foam, a perforated element, a woven, a non-woven, a felt, and a mesh.

105. The applicator device of claim 85, wherein the removable closure member is configured such that sealable closing of the opening causes the second end portion of the applicator member to move from the first position to the second position.

106. The applicator device of claim 85, wherein at least one of the support and the applicator member has open pores or cells of a mean size ranging from 50 $\mu$m to 1.5 mm.

107. The applicator device of claim 85, wherein the reservoir includes a compressible body.

108. The applicator device of claim 107, wherein the compressible body is a deformable tube.

109. The applicator device of claim 107, wherein said body includes at least one elastically deformable portion.

110. The applicator device of claim 85, wherein at least one of the applicator member and the support is made of foam.

111. The applicator device of claim 85, wherein the applicator member is removably mounted in the reservoir.

112. The applicator device of claim 85, wherein the compressibility of the support is approximately two to four times greater than the compressibility of the applicator member.

113. The applicator device of claim 85, wherein the reservoir contains the product and the product is a cosmetic product.

114. The applicator device of claim 85, wherein the reservoir contains the product and the product is one of a glue, a correction fluid, and a stain remover.

115. A method of applying a cosmetic product, comprising:

providing the applicator device of claim 85 with a cosmetic product in the reservoir;

pressing on the product application surface of the applicator member to supply the cosmetic product to the applicator member; and placing the product application surface in contact with an area to be treated to apply the cosmetic product.

116. The applicator device of claim 85, further comprising a liquid cosmetic product, wherein the reservoir contains the liquid cosmetic product.

117. An applicator device for a liquid product, the applicator comprising:

a reservoir for containing the liquid product, the reservoir having an opening;

a removable closure member for sealably closing the opening;

an applicator member provided in the reservoir, the applicator member including a first end portion configured to be impregnated with the product and a second end portion, opposite the first end portion, the second end portion including a product application surface and being axially moveable between a first position wherein the second end portion extends out of the reservoir through the opening, and a second position wherein the second end portion is at least substantially contained in the reservoir, the applicator member comprising an absorbent material and configured to be at least partially compressed; and an elastically compressible support supporting the applicator member in the reservoir, the support having a compressibility greater than the compressibility of the applicator member;

wherein the applicator member is configured to release product absorbed by the applicator member in response to compression of the application member.

118. The applicator device of claim 117, wherein the applicator member has a compressibility such that the applicator member becomes compressed during at least one of application of product via the product application surface and placement of the applicator member in the second position.

119. The applicator device of claim 117, wherein the support includes an element that is distinct from the applicator member.

120. The applicator device of claim 117, wherein said support includes a spring.

121. The applicator device of claim 120, wherein the spring is formed of one of plastic and metal.

122. The applicator device of claim 117, wherein the support includes at least one block of an elastically deformable material.

123. The applicator device of claim 122, wherein the support includes a block of foam.

124. The applicator device of claim 123, wherein the block of foam includes one of open cells and semi-open cells.

125. The applicator device of claim 122, wherein the at least one block of elastically deformable material of the support is secured to the applicator member.

126. The applicator device of claim 117, wherein the applicator member is attached to the support.

127. The applicator device of claim 126, wherein the applicator member is attached to the support by one of bonding, welding, and crimping.

128. The applicator device of claim 117, wherein the support has at least one portion integral with the applicator member, said at least one portion being configured to have greater compressibility than the remainder of the applicator member.

129. The applicator device of claim 117, wherein the difference in compressibility between the applicator member and the support results from the presence of an indentation formed on the applicator member on at least part of its periphery.

130. The applicator device of claim 117, wherein the applicator member includes at least one passage passing through it.

131. The applicator device of claim 130, wherein the passage terminates adjacent to the product application surface.

132. The applicator device of claim 117, wherein the applicator member and the support are arranged inside a housing provided at least partially inside a neck of the reservoir, the housing being configured to be in fluid communication with the liquid product in the reservoir.

133. The applicator device of claim 132, further comprising a perforated element separating the housing from the liquid product in the reservoir.

134. The applicator device of claim 133, wherein the perforated element is configured to provide one-way flow towards the product application surface.

135. The applicator device of claim 117, wherein the applicator member is formed from a block of one of open-cell foam and semi-open cell foam.

136. The applicator device of claim 117, wherein the applicator member includes, near the product application surface, one of a rigid foam, a perforated element, a woven, a non-woven, a felt, and a mesh.

137. The applicator device of claim 117, wherein the removable closure member is configured such that sealable closing of the opening causes the second end portion of the applicator member to move from the first position to the second position.

138. The applicator device of claim 117, wherein at least one of the support and the applicator member has open pores or cells of a mean size ranging from 50 $\mu$m to 1.5 mm.

139. The applicator device of claim 117, wherein the reservoir includes a compressible body.

140. The applicator device of claim 139, wherein the compressible body is a deformable tube.

141. The applicator device of claim 139, wherein said body includes at least one elastically deformable portion.

142. The applicator device of claim 117, wherein at least one of the applicator member and the support is made of foam.

143. The applicator device of claim 117, wherein the applicator member is removably mounted in the reservoir.

144. The applicator device of claim 117, wherein the compressibility of the support is approximately two to four times greater than the compressibility of the applicator member.

145. The applicator device of claim 117, wherein the reservoir contains the product and the product is a cosmetic product.

146. The applicator device of claim 117, wherein the reservoir contains the product and the product is one of a glue, a correction fluid, and a stain remover.

147. A method of applying a cosmetic product, comprising:

providing the applicator device of claim 117 with a cosmetic product in the reservoir;

pressing on the product application surface of the applicator member to supply the cosmetic product to the applicator member; and placing the product application surface in contact with an area to be treated to apply the cosmetic product.

148. The applicator device of claim 117, further comprising a liquid cosmetic product, wherein the reservoir contains the liquid cosmetic product.

* * * * *

UNITED STATES PATENT AND TRADEMARK OFFICE

CERTIFICATE OF CORRECTION

PATENT NO. : 6,883,995 B1
DATED : April 26, 2005
INVENTOR(S) : Jean-Louis Gueret It is certified that error appears in the above-identified patent and that said Letters Patent is hereby corrected as shown below:

Column 18,
Line 65, after "wherein", delete "the";

Column 19,
Line 6, replace "7001 μm" with -- 700 μm --;

Column 20,
Line 43, replace "opening, and" with -- opening; and --; and

Column 21,
Line 41, replace "opening, and" with -- opening; and --.

Signed and Sealed this

Nineteenth Day of July, 2005

JON W. DUDAS
*Director of the United States Patent and Trademark Office*